US006038955A

United States Patent [19]

Thiesen et al.

[11] Patent Number: 6,038,955

[45] Date of Patent: Mar. 21, 2000

[54] METHOD FOR AIMING THE WEAPON OF A WEAPON SYSTEM AND WEAPON SYSTEM FOR IMPLEMENTING THE METHOD

[75] Inventors: Stefan Thiesen, Willich; Dieter Jungbluth, Herschbach; Jürgen Böcker, Oberhausen, all of Germany

[73] Assignee: Rheinmetall W.& M. GmbH, Ratingen, Germany

[21] Appl. No.: 09/061,322

[22] Filed: Apr. 17, 1998

[30] Foreign Application Priority Data

Apr. 18, 1997 [DE] Germany ..... 197 16 199

[51] Int. Cl.[7] ..... F41G 1/00

[52] U.S. Cl. ..... 89/41.17; 89/41.06

[58] Field of Search ..... 89/41.17, 41.06, 89/41.19

[56] References Cited

U.S. PATENT DOCUMENTS

| | | | |
|---|---|---|---|
| 3,757,632 | 9/1973 | Bellinger | 102/87 |
| 4,015,258 | 3/1977 | Smith et al. . | |
| 4,202,246 | 5/1980 | Schertz et al. . | |
| 4,579,035 | 4/1986 | Whiting | 89/41.05 |
| 4,698,489 | 10/1987 | Hicken et al. | 235/407 |
| 4,787,291 | 11/1988 | Frohock, Jr. | 89/41.22 |
| 5,208,418 | 5/1993 | Toth et al. | 89/41.07 |
| 5,375,072 | 12/1994 | Cohen | 364/561 |
| 5,467,682 | 11/1995 | Brooks | 89/41.22 |
| 5,596,509 | 1/1997 | Karr | 364/516 |

FOREIGN PATENT DOCUMENTS

| | | |
|---|---|---|
| 0 261 091 A3 | 3/1988 | European Pat. Off. . |
| 2306334 | 9/1974 | Germany . |
| 3238848 | 5/1983 | Germany . |
| 1419471 | 1/1974 | United Kingdom . |
| 1563094 | 9/1975 | United Kingdom . |
| 1 419 471 | 12/1975 | United Kingdom . |
| 1 563 094 | 3/1980 | United Kingdom . |
| 2107835 | 5/1983 | United Kingdom . |

*Primary Examiner*—Charles T. Jordan
*Assistant Examiner*—Jeff Howell
*Attorney, Agent, or Firm*—Venable; Norman N. Kunitz

[57] ABSTRACT

A method for aiming the weapon (4) of a weapon system (1) with an aiming system (5) and a heat imaging device (6) while considering external influences acting on the projectiles to be fired into a target region (3). In order to accomplish that influences acting on the projectiles (2) during their flight into the target region (3) are considered in a simple manner for the aiming of the weapon (4), the amount of lateral deviation (13) of the point of impact (11) of the projectile from a predetermined point of aim (12) of the weapon (4)is determined by measuring or tracking the tracer (10) of the projectile (2) by the heat imaging device (6). The amount of lateral deviation (13) thus determined is then compensated for in the subsequent firing by a corresponding lateral aiming correction of the weapon (4). A weapon system (1) for implementing the method is likewise disclosed.

5 Claims, 1 Drawing Sheet

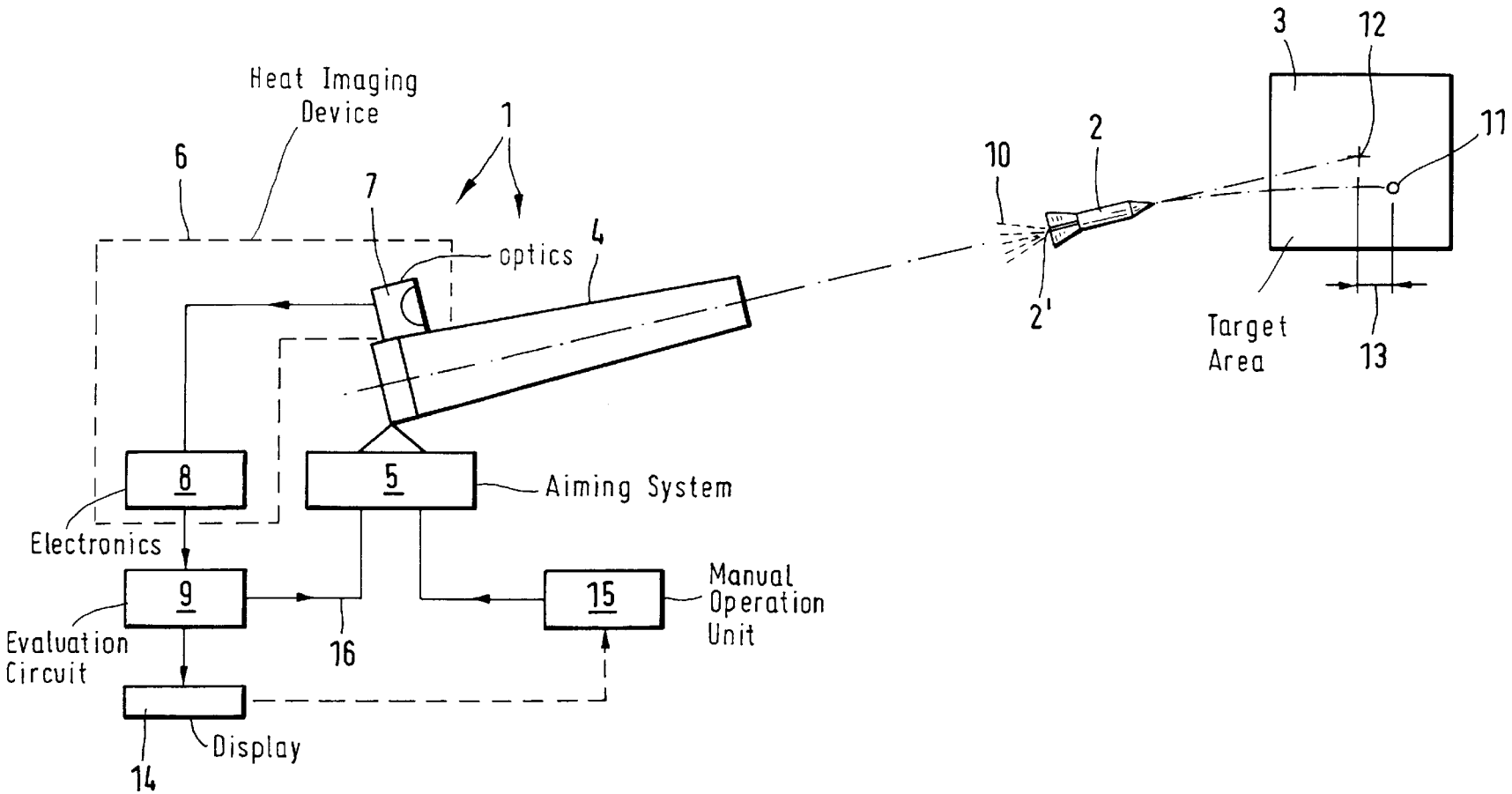
11
12
13
3
Target Area
2
2'
10
4
1
optics
Heat Imaging Device
7
6
Aiming System
5
Manual Operation Unit
15
16
8
9
Display
14
Electronics
Evaluation Circuit

METHOD FOR AIMING THE WEAPON OF A WEAPON SYSTEM AND WEAPON SYSTEM FOR IMPLEMENTING THE METHOD

REFERENCE TO RELATED APPLICATIONS

This application claims the priority of German application Ser. No. 197 16 199.5, filed Apr. 18, 1997, which is incorporated herein by reference.

BACKGROUND OF THE INVENTION

The invention relates to a method for aiming a weapon system with an aiming system and a heat imaging device. Furthermore, the invention relates to a weapon system for implementing the method.

Whether a projectile fired by a weapon system, e. g., by a battle tank, actually hits a target, depends on a number of different influencing quantities. Especially the respectively prevailing weather has a large influence on the trajectory of the projectile. With particular frequency, lateral deviations of the impact location from a predetermined point of aim (amount of lateral deviation) are caused by a cross-wind. Therefore, it has already been suggested to install a wind measuring system on the respective weapon system and to consider the measured values (wind direction, wind force) that are determined with this system for the aiming of the weapon.

But for the as usual effective combat ranges of tanks (approximately 2000 to 3000 m), the correction values measured by an anemometer system arranged on the battle tank are not very informative. This is, particularly true when the tank stands in sheltered location, since entirely different wind relationships may prevail on the further flight of the respective projectile than at the position of the tank.

It therefore is the object of the present invention to provide a method of the type originally mentioned above whereby influences on the amount of lateral deviation of a projectile, in particular, weather influences, can be considered in a simple manner for the aiming of the weapon so as to considerably enhance the hitting accuracy of the subsequent firing. A further object is to disclose a weapon system for implementing the method.

SUMMARY OF THE INVENTION

The above object is achieved according to the invention with regard to the method by a method for aiming a weapon of a weapon system having an aiming system and a heat imaging device, with the method comprising the sequential steps of: designating a predetermined point of aim in a target region: firing a tracer projectile toward the target area; tracking the trajectory of the tracer projectile with the heat imaging device; from tracking data for the projectile detected by the heat imaging device, determining the amount of lateral deviation of the point of impact of the tracer projectile in the target region from the predetermined point of aim using an evaluation arrangement connected downstream of the heat imaging device; and, supplying the determined deviation values to at least one of a display device for displaying the deviation and to the aiming system for readjustment of the aim of the weapon.

The above object generally is achieved according to a further aspect of the invention by a weapon system for the firing of projectiles, particularly of tracer projectiles, comprising: a tubular weapon; an aiming system coupled to the weapon; a heat imaging device oriented at a target region for the weapon; an evaluation circuit arrangement, connected downstream of the heat imaging device for determining, when a tracer projectile is fired, the amount of deviation of a point of impact of the respective tracer projectile in the target region from a predetermined point of aim on the basis of the tracer projector data detected by the heat image device, and for generating corresponding signal values from the determined value.

The invention is substantially based on the concept of determining the amount of lateral deviation of the point of impact of the projectile from a predetermined point of aim by measuring or tracking the tracer of the projectile with a heat imaging device. The amount of lateral deviation thus determined is then compensated for by a corresponding lateral aiming correction of the weapon for the subsequent firing.

The method according to the invention can be realized in a simple and economical manner especially for weapon systems of battle tanks because such weapon systems already have an aiming system as well as a heat imaging device.

In an advantageous embodiment of the invention, the weapon only fires tracer bullets. As a result, the weapon can be tracked continuously with respect to a point of aim predetermined by, e. g., the gunner.

Further details and advantages of the invention ensue from the embodiment below which is explained by way of a drawing figure.

BRIEF DESCRIPTION OF THE DRAWINGS

The FIGURE is a schematic illustration of a weapon system according to the invention.

DETAILED DESCRIPTION OF THE PREFERRED EMBODIMENTS

The FIGURE shows a schematically illustrated weapon system 1, a tracer projectile 2 fired by the weapon system 1, with the tracer projectile 2 having a rear-mounted tracer charge 21, and a target region 3 (e. g., the turret of an enemy tank), pivoted into the visual plane.

The weapon system 1 comprises a tubular weapon 4, an aiming system 5, which is mechanically coupled to the tubular weapon 4, and a heat imaging device 6 with a lens or optical system 7 mounted as the tubular weapon 4 and with a downstream connected electronic system 8. The electronic system 8 of the heat imaging device 6 is connected to an electronic signal evaluation arrangement 9 which automatically measures or determines the position of tracer 10 of the projectile 2 from the data measured by the heat imaging device 6, and compares the point of impact 11 of the projectile 2 in the target region 3 with the point of aim 12 predetermined by the gunner and fed to the evaluation arrangement 9, for example, manually, by the gunner or by the aiming system 5 via line 6, and determines the amount of lateral deviation 13 from these values. The amount of lateral deviation 13 determined by the evaluation arrangement 9 is then displayed on a display device 14 for the gunner.

In a first alternative, the gunner can manually operate the aiming system 5 on the basis of the displayed deviation values 13 via an operating unit 15 and thus correct the position of the tubular weapon 4 accordingly.

In a second alternative, corresponding signal values are obtained from the determined deviation values 13 by means of the signal evaluation arrangement 9, and these signal values are supplied, via the line 16, to the aiming system 5 for the automatic tracking of the tube weapon 4 to correct the point of aim 12.

The invention now being fully described, it will be apparent to one of ordinary skill in the art that many changes and modifications can be made thereto without departing from the spirit or scope of the invention as set forth herein.

What is claimed:

1. A method for aiming a weapon of a weapon system having an aiming system and a heat imaging device, said method comprising the sequential steps of:

designating a predetermined point of aim in a target region:

firing a tracer projectile toward the target region;

tracking the trajectory of the tracer projectile with the heat imaging device;

from tracking data for the projectile detected by the heat imaging device, determining the amount of lateral deviation of the point of impact of the tracer projectile in the target region from the predetermined point of aim using an evaluation arrangement connected downstream of the heat imaging device; and, supplying the determined deviation values to at least the aiming system for readjustment of the aim of the weapon.

2. A method according to claim 1, wherein the weapon fires only tracer projectiles and the deviation values determined with the assistance of the evaluation arrangement are continuously supplied to the aiming system as correction values.

3. A method accordingly to claim 1 wherein the step of supplying includes additionally supplying the deviation values to a display for displaying the deviation values.

4. A weapon system for the firing of projectiles, particularly of tracer projectiles, comprising: a tubular weapon; an aiming system coupled to the weapon; a heat imaging device oriented at a target region for the weapon; and an evaluation circuit arrangement, connected downstream of the heat imaging device, for determining, when a tracer projectile is fired, the amount of deviation of a point of impact of the respective tracer projectile in the target region from a predetermined point of aim on the basis of tracer projectile data detected by the heat imagine device, and for generating corresponding signal values from the determined value, and with the evaluation circuit arrangement being connected to the aiming system via a line, so that the signal values corresponding to the deviation values are directly fed to and used by the aiming system for control of the aiming system.

5. A weapon system according to claim 4, further comprising a display device connected downstream of the evaluation arrangement for displaying determined deviation values.

* * * * *